US005413623A

United States Patent [19]

Oonuki et al.

[11] Patent Number: 5,413,623

[45] Date of Patent: May 9, 1995

[54] PROCESS AND APPARATUS FOR VACUUM DEGASSING MOLTEN STEEL

[75] Inventors: Kazuo Oonuki; Teruyoshi Hiraoka; Hiroshi Nagahama; Kazuhisa Fukuda; Akira Nobumoto; Takahiro Isono; Atsumi Yamada; Hiroki Gofuku, all of Himeji, Japan

[73] Assignee: Nippon Steel Corporation, Tokyo, Japan

[21] Appl. No.: 111,413

[22] Filed: Aug. 25, 1993

[30] Foreign Application Priority Data

Aug. 26, 1992 [JP] Japan ..... 4-227469
Aug. 26, 1992 [JP] Japan ..... 4-227633

[51] Int. Cl.[6] ..... C21C 7/00
[52] U.S. Cl. ..... 75/508; 75/512
[58] Field of Search ..... 75/508, 512, 530

[56] References Cited

U.S. PATENT DOCUMENTS

| | | | |
|---|---|---|---|
| 3,333,619 | 8/1967 | Denis | 431/346 |
| 3,439,072 | 4/1969 | Lyman | 432/4 |
| 3,534,948 | 10/1970 | Wade | 239/132.3 |
| 3,706,549 | 12/1972 | Knuppel | 75/530 |
| 3,759,700 | 9/1973 | Diener et al. | 75/512 |
| 4,979,983 | 12/1990 | Nishikawa et al. | 75/511 |
| 4,979,983 | 12/1990 | Nishikawa | 75/521 |
| 4,994,108 | 2/1991 | Hamagami | 75/508 |

FOREIGN PATENT DOCUMENTS

| | | |
|---|---|---|
| 2112227 | 6/1972 | France . |
| 53-81416 | 7/1978 | Japan . |
| 64-217 | 1/1989 | Japan . |
| 1-195239 | 8/1989 | Japan . |
| 1354016 | 5/1974 | United Kingdom . |

*Primary Examiner*—Peter D. Rosenberg
*Attorney, Agent, or Firm*—Wenderoth, Lind & Ponack

[57] ABSTRACT

Molten steel is efficiently vacuum treated in a vacuum treatment vessel provided with a top blow lance capable of injecting oxygen and a gaseous fuel at desired flow rates, respectively, into the molten steel. The blow lance is provided on the top of the vacuum treatment vessel and is supported so as to be freely vertically movable. By spacing the lower end of the top blow lance not more than 2 m from the surface of the molten steel bath and injecting only oxygen onto the molten steel, and spacing the lower end of the top blow lance 1.0 m or more from the surface of the molten steel bath and injecting both oxygen and a gaseous fuel gas onto the molten steel, the temperature of the molten steel is prevented from decreasing during the vacuum treatment and the molten steel is so prevented from depositing on the inside wall of the vacuum treatment vessel. The top blow lance includes an oxygen injection section having a throat and a tapered portion connected to the lower end of the throat, and a plurality of fuel gas supply ports provided in the tapered portion. The throat and tapered portion are coaxial with the axial center line of the lance.

35 Claims, 7 Drawing Sheets

FIG. 1(a)
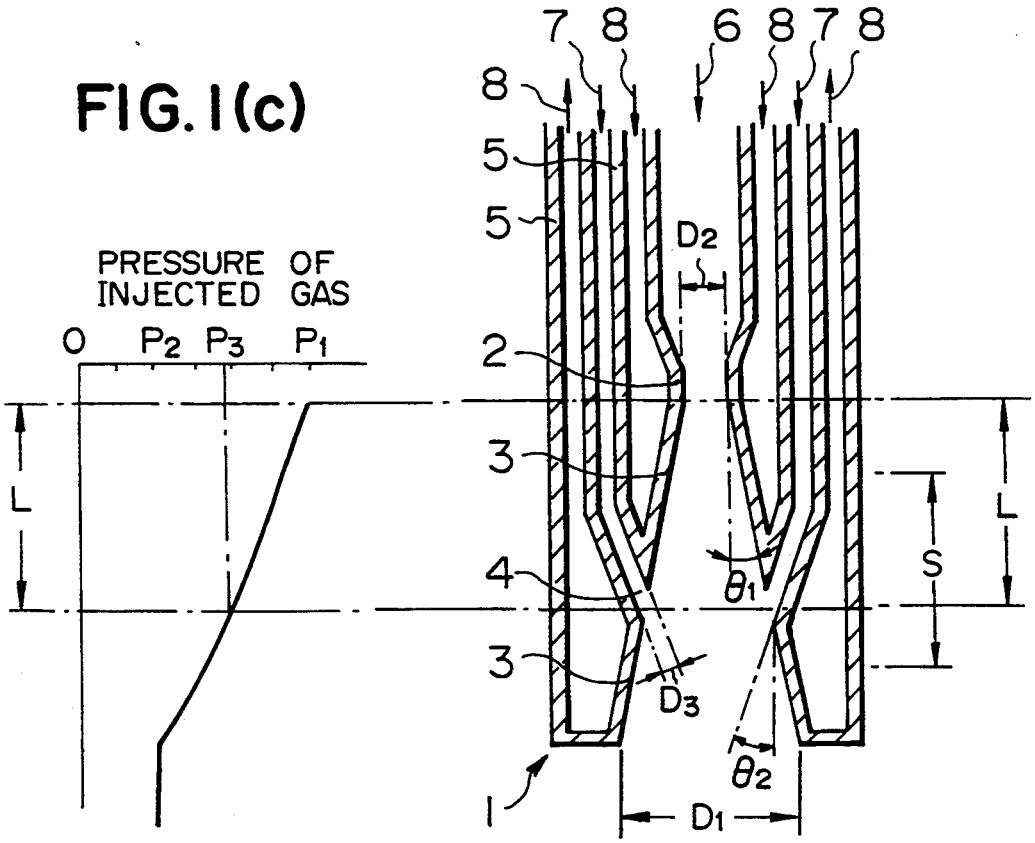
FIG. 1(c)
FIG. 1(b)
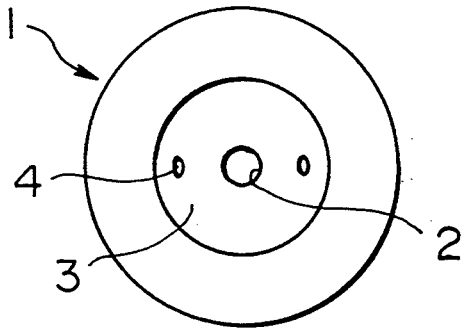

(UNDER ATMOSPHERIC PRESSURE)

(UNDER VACUUM)

PRESUMPTION OF THE STATE OF FLAME

PROCESS AND APPARATUS FOR VACUUM DEGASSING MOLTEN STEEL

BACKGROUND OF THE INVENTION

1) Field of the Invention

The present invention relates to a process and an apparatus for vacuum degassing molten steel in a vacuum treatment vessel such as an RH vacuum treatment vessel, a DH vacuum treatment vessel, a ladle vacuum treatment vessel comprising a casing for encasing a ladle and a top cover for shielding the ladle from the surrounding atmosphere and a treatment vessel immersed in a ladle, and relates to an apparatus for vacuum degassing molten steel, which is used in a secondary refining process.

2) Prior Art

Recently, mass-produced high grade steel has been often subjected to a secondary refining treatment in a vacuum treatment vessel, and above all such operations as to supply an oxygen gas to molten steel in an RH vacuum treatment vessel to positively decarburize the moten steel or as to positively heat the molten steel have been widely carried out. However, such vacuum treatments have such problems as a decrease in the temperature of molten steel and deposition of much molten steel on the inside walls of the RH vacuum treatment vessel.

Heretofore, it has been proposed to provide a heater of electrical resistance type in the RH vacuum treatment vessel, but the conventional heater of electric resistance type is not enough to prevent the decrease in the temperature of molten steel or the deposition of molten steel. Furthermore, the conventional heater of electrical resistance type suffers from a high capital investment, a high electrode consumption per unit production and a high power cost, resulting in higher decarburization treatment cost.

According to the present inventor's knowledge, the decrease in the temperature of molten steel and deposition of molten steel can be prevented to some extent by thoroughly preheating the inside of an RH vacuum treatment vessel in which molten steel has not been treated yet and which is on standby. However, it has problems such that the heating capacity of the conventional heater of electrical resistance type is not enough and electrode and power costs are so high as to increase the RH vacuum treating cost.

Japanese Patent Application Kokai (Laid-open) No. 53-81416 discloses a process comprising adding Al, Si and the like into molten steel and heating the molten steel by injecting an oxygen gas into the molten steel in a vacuum treatment vessel. However, it has such problems that expensive materials such as Al, Si and the like must be used and there is a high chance for deposition of molten steel on the inside wall of the vacuum treatment vessel.

U.S. Pat. No. 4,979,983 discloses a process for injecting an oxygen gas onto the molten steel surface in a vacuum treatment vessel and combusting the CO gas generated from the molten steel in the vacuum treatment vessel through reaction with the injected oxygen gas. However, it has such problems that the heat source is only the CO gas generated from the molten steel, and thus the steel species to be treated is limited only to the steel species to be decarburized, and the heating capacity also depends on the amount of generated CO gas. Thus, there is an insufficient case for preventing the decrease in the temperature of molten steel, and the deposition of molten steel on the inside wall of the vacuum treatment vessel is hard to effectively prevent, because of the limited heating capacity of the heat source.

Japanese Patent Application Kokai (Laid-open) No. 64-217 discloses a process comprising injecting a combustible gas into molten steel in a vacuum treatment vessel while supplying an oxygen gas over the surface of molten steel bath in the vacuum treatment vessel at the same time, thereby heating the molten steel to a higher temperature, but it has such a problem that the C and H contents of the molten steel increase because of the injection of the combustible gas into the molten steel, and the structure and maintenance of an apparatus for injecting the combustible gas into the molten steel are complicated. According to the present inventor's knowledge, the flow rate of the combustible gas to be injected into the molten steel is limited, and thus it is hard to effectively prevent the deposition of molten steel on the inside wall of the vacuum treatment vessel.

Japanese Patent Application Kokai (Laid-open) No. 1-195239 discloses a plurality of gas combustion burners for sole use in the prevention of molten steel deposition on the inside wall of a vacuum treatment vessel, and also in remelting and removal of the deposited steel, and also discloses a lance provided with a plurality of burners, but handling of a plurality of gas combustion burners or a lance provided with a plurality of burners is troublesome, and it is hard to use the disclosed technics at not more than 100 Torr and it is also hard to heat the molten steel or refractories of the wall of the vacuum treatment vessel to a enough higher temperature.

SUMMARY OF THE INVENTION

An object of the present invention is to provide a process for vacuum treating molten steel with a high efficiently, capable of preventing a decrease in the temperature of molten steel during the vacuum treatment without using a large scale heater of electric resistance type and without using expensive ferroalloys of Al, Si and the like, and also capable of preventing deposition of molten steel on the inside wall of a vacuum treatment vessel, which process comprises a vacuum degassing treatment composed of a decarburization treatment or dehydrogenation treatment, a deoxidization treatment, if required, and a composition adjustment treatment, if required.

Another object of the present invention is to provide an apparatus for vacuum degassing, capable of conducting an efficient decarburization treatment by single oxygen gas injection or single oxygen-containing gas injection through a single top blow lance during a vacuum treatment, capable of both efficiently heating molten steel by combustion of a fuel gas with an oxygen gas or an oxygen-containing gas and preventing deposition of molten steel on the inside wall of a vacuum treatment vessel, and also capable of heating the inside wall of the vacuum treatment vessel under the atmospheric pressure, which is on standby, to a sufficiently high temperature or of remelting away the deposited steel.

Other object of the present invention is to provide an apparatus for vacuum degassing, capable of reducing the treating cost because of unnecessity for expensive electrode and power and electrical facility.

These objects of the present invention can be attained according to the following process and apparatus for vacuum degassing molten steel.

(1) A process for vacuum degassing molten steel in a vacuum degassing treatment of molten steel, characterized by providing a top blow lance capable of injecting an oxygen gas or oxygen-containing gas and a fuel gas at desired flow rates, respectively, on the top of a vacuum treatment vessel in a freely upward and downward movable manner, arranging the lower end of the top blow lance at a level of 1.0 m or more from the surface of a molten steel bath and injecting both of the oxygen gas or oxygen-containing gas and the fuel gas in the vacuum treatment vessel in a stage when a pressure in the vacuum treatment vessel is not more than 50 Torr in the vacuum degassing treatment of molten steel, thereby elevating a temperature of the molten steel and preventing a deposition of the molten steel on the inside wall of the vacuum treatment vessel.

(2) A process for vacuum degassing molten steel in a vacuum degassing treatment of molten steel, characterized by providing a top blow lance capable of injecting an oxygen gas or oxygen-containing gas and a fuel gas at desired flow rates, respectively, on the top of a vacuum treatment vessel in a freely upward and downward movable manner, arranging the lower end of the top blow lance at a level of 1.0 m or more from the surface of a molten steel bath and injecting both of the oxygen gas or oxygen-containing gas and the fuel gas in the vacuum treatment vessel., the injection being started from a stage when a pressure in the vacuum treatment vessel is lower than a pressure at the time when a reflux of the molten steel starts and being continued through a period of the vacuum degassing treatment, thereby elevating a temperature of the molten steel and preventing a deposition of the molten steel on the inside wall of the vacuum treatment vessel.

(3) A process for vacuum degassing molten steel in a vacuum degassing treatment of molten steel, characterized by carrying out a decarburization treatment by setting the lower end of a top blow lance to a level of not more than 2 m from the surface of a molten steel bath and injecting only an oxygen gas to the molten steel from the top blow lance, and subsequently arranging the lower end of the top blow lance at a level of 1.0 m or more from the surface of the molten steel bath, the top blow lance being capable of injecting an oxygen gas or oxygen-containing gas and a fuel gas at desired flow rates, respectively, and being provided on the top of a vacuum treatment vessel in a freely upward and downward movable manner, and injecting both of the oxygen gas or oxygen-containing gas and the fuel gas in the vacuum treatment vessel, thereby elevating a temperature of the molten steel and preventing a deposition of the molten steel on the inside wall of the vacuum treatment vessel.

(4) A process for vacuum degassing molten steel in a vacuum degassing treatment of molten steel, characterized by carrying out a decarburization treatment by setting the lower end of a top blow lance to a level of not more than 2 m from the surface of a molten steel bath and injecting only an oxygen gas to the molten steel from the top blow lance and subsequently carrying out a deoxidation treatment and successively arranging the lower end of the top blow lance at a level of 1.0 m or more from the surface of the molten steel bath, the top blow lance being capable of injecting an oxygen gas or oxygen-containing gas and a fuel gas at desired flow rates, respectively, and being provided on the top of a vacuum treatment vessel in a freely upward and downward movable manner, and injecting both of the oxygen gas or oxygen-containing gas and the fuel gas in the vacuum treatment vessel, thereby elevating a temperature of the molten steel and preventing a deposition of the molten steel on the inside wall of the vacuum treatment vessel.

(5) A process for vacuum degassing molten steel, characterized by comprising a step of providing a top blow lance capable of injecting an oxygen gas and a fuel gas at desired flow rates, respectively, on the top of a vacuum treatment vessel in a freely upward and downward movable manner, arranging the lower end of the top blow lance at a level of not more than 2 m from the surface of a molten steel bath and injecting only an oxygen gas to the molten steel from the top blow lance directed to a decarburization treatment; and a step of arranging the lower end of the top blow lance at a level of 1.0 m or more from the surface of the molten steel bath and injecting both of the oxygen gas and the fuel gas in the vacuum treatment vessel from the top blow lance; and combining the steps as desired, thereby promoting decarburization of the molten steel, elevating the temperature of the molten steel and preventing deposition of the molten steel onto the inside wall of the vacuum treatment vessel.

(6) A process according to (5), wherein in the step of injecting only the oxygen gas to an undeoxidized molten steel, thereby promoting the decarburization, the injection of the oxygen gas is discontinued when the carbon content of the molten steel reaches a desired content, and the step of injecting both of the oxygen gas and the fuel gas is started to heat the molten steel and prevent a deposition of the molten steel on the inside wall of the vacuum treatment vessel.

(7) A process according to (6), wherein the step of injecting the oxygen gas to the undeoxidized molten steel is discontinued when the carbon content of the molten steel reaches 0.02 to 0.005% by weight.

(8) A process according to (7), wherein the step of injecting the oxygen gas to the undeoxidized molten steel is discontinued when the carbon content of the molten steel reaches 0.01% by weight.

(9) A process according to (5), wherein in the step of injecting the oxygen gas to the undeoxidized molten steel, thereby promoting the decarburization, the injection of the oxygen gas is discontinued, when the carbon content of the molten steel reaches a desired content, and thereafter until the carbon content of the molten steel reaches a desired content, a vacuum decarburization treatment is carried out while discontinuing the injection of the oxygen gas, thereby preventing a deterioration of vacuum degree, and after the decarburization treatment, a deoxidation treatment and, if necessary, a composition adjustment treatment are carried out by injecting both of the oxygen gas and the fuel gas in the vacuum treatment vessel, thereby promoting the decarburization of the molten steel, elevating the temperature of the molten steel and preventing deposition of the molten steel onto the inside wall of the vacuum treatment vessel.

(10) A process according to (9), wherein the injection of the oxygen gas to the undeoxidized molten steel is discontinued when the carbon content of the molten steel reaches 0.02 to 0.005% by weight.

(11) A process according to (10), wherein the injection of the oxygen gas to the undeoxidized molten steel is discontinued when the carbon content of the molten steel reaches 0.01% by weight.

(12) A process according to any one of (9) to (11), wherein the vacuum decarburization treatment is finished when the carbon content of the molten steel reaches 0.0005 to 0.020% by weight.

(13) A process according to (5), which comprises providing a top blow lance capable of injecting both of an oxygen gas and a fuel gas at desired flow rates, respectively, on the top of a vacuum treatment vessel in a freely upward and downward movable manner, setting the lower end of the top blow lance to a level of not more than 2 m from the surface of a molten steel bath, injecting only the oxygen gas to an undeoxidized molten steel from the top blow lance until a carbon content of the molten steel reaches 0.02 to 0.005% by weight, then setting the lower end of the top blow lance to a level of 1.0 m or more from the surface of molten steel bath, and injecting both of the oxygen gas and the fuel gas in the vacuum treatment vessel from the top blow lance until the decarburization treatment is finished, and further after a deoxidation treatment, a vacuum treatment such as a composition adjustment treatment is finished, thereby promoting decarburization of the molten steel, elevating the temperature of the molten steel and preventing deposition of the molten steel on the inside wall of the vacuum treatment vessel.

(14) A process according to (5), which comprising providing a top blow lance capable of injecting an oxygen gas and a fuel gas at desired rates, respectively, on the top of a vacuum treatment vessel in a freely upward and downward movable manner, setting the lower end of the top low lance to a level of not more than 2 m from the surface of a molten steel bath, injecting only the oxygen gas to an undeoxidized molten steel from the top blow lance until the carbon content of the molten steel reaches 0.02 to 0.005% by weight, then conducting a vacuum decarburization treatment while discontinuing the injection of the oxygen gas until the vacuum decarburization treatment is finished, thereby preventing a deterioration in a vacuum degree, and injecting both of the oxygen gas and the fuel gas in the vacuum treatment vessel from the top blow lance until a vacuum treatment such as a deoxidation treatment and a composition adjustment treatment is finished, thereby promoting decarburization of the the molten steel, elevating the temperature of the molten steel and preventing deposition of the molten steel on the inside wall of the vacuum treatment vessel.

(15) An apparatus for vacuum degassing which comprises a vacuum treatment vessels and a top blow lance provided vertically in the vacuum treatment vessel in a freely upward and downward movable manner, the top blow lance comprising an oxygen gas injection region comprising a throat part and a tapered region connected to the lower end of the throat part, both of the throat part and the tapered region being provided along the axial center line of the lance, and a plurality of fuel gas supply ports provided on the tapered surface of the tapered region.

(16) An apparatus according to any one of (15), wherein a plurality of the fuel gas supply ports are provided symmetrically to the axial center line of the top blow lance.

(17) An apparatus according to (16), wherein 3 to 6 fuel gas supply ports are provided symmetrically to the axial center line of the top blow lance.

(18) An apparatus according to any one of (15) to (17), wherein the vacuum treatment vessel is one as selected from a group consisting of an RH vacuum treatment vessel, a DH vacuum treatment vessel and a ladle vacuum treatment vessel.

(19) An apparatus according to (15), which comprises a vacuum treatment vessel selected from a group consisting of an RH vacuum treatment vessel, a DH vacuum treatment vessel, a treatment vessel immersed in molten steel and a ladle vacuum treatment vessel and a top blow lance vertically provided in the vacuum treatment vessel in a freely upward and downward movable manner, and the top blow lance comprises an oxygen injection region comprising a throat part and a tapered region connected to the lower end of the throat part, provided along the axial center line of the top blow lance, and 3 to 6 fuel gas supply ports being provided symmetrically to the axial center line of the top blow lance and on the tapered surface of the tapered region, the tapered region having a taper angle $\theta_1$ of 1° to 20°, a ratio of diameter $D_1$ of the lower end to diameter $D_2$ of the upper end of the tapered region, $D_1/D_2$, of 1 to 40, and the fuel gas supply ports being provided on the tapered surface at the position, which is lower than that at which the pressure of the injected oxygen gas from the throat part is equal to the discharge pressure of the fuel gas and which is higher by at least 5 mm than the lower end of the tapered region.

BRIEF DESCRIPTION OF THE DRAWINGS

FIG. 1(*a*) is a schematic vertical cross-sectional view showing one example of the injection outlet region of a top blow lance according to the present invention, FIG. 1(*b*) is a bottom side view of FIG. 1(*a*), and FIG. 1(*c*) is a diagram showing changes in the pressure of the injected oxygen gas in the oxygen gas injection outlet region.

DETAILED DESCRIPTION OF THE INVENTION

Figure 2A:
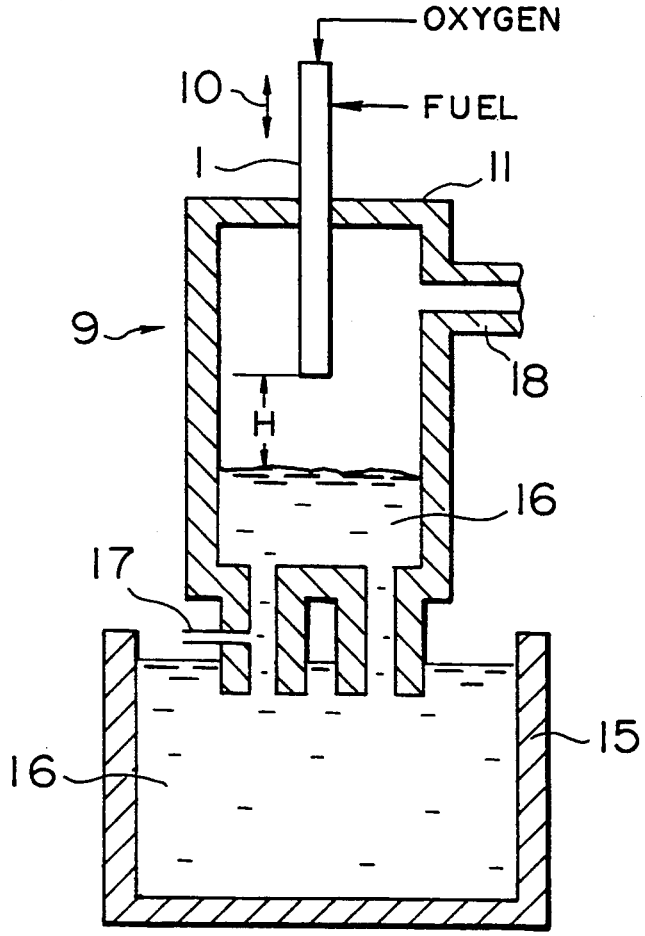
FIG. 2(*a*) is a schematic vertical cross-sectional view showing one example of the arrangement and supporting of a top blow lance according to the present invention, and FIG. 2(*b*) is a schematic vertical cross-sectional view showing the sealing state of a top blow lance 1 at the top of a vacuum treatment vessel.

The present invention will be explained in detail below, referring to an RH vacuum degassing process as a typical vacuum treatment process.

In the present invention, a top blow lance capable of injecting an oxygen gas, an oxygen-containing gas and a fuel gas at desired flow rates, respectively, is used. FIG. 1(*a*) is a schematic vertical cross-sectional view showing the injection outlet region of a top blow lance, FIG.

1(*b*) is a bottom side view of FIG. 1(*a*), and FIG. 1(*c*) is a diagram showing changes in the pressure of injected oxygen gas in the oxygen gas injection outlet region.

In the present invention, a top blow lance 1 comprises an oxygen gas passage provided along the axial center line of the top blow lance 1, the oxygen gas passage having a tapered region 3 from the throat part 2 downwards, and a plurality of fuel gas supply (injection) ports 4, provided symmetrically to the axial center line in the tapered region 3. In FIG. 1(*a*), numeral 5 is a water cooling region, 6 an oxygen gas or an oxygen-containing gas, 7 a fuel gas such as LNG, COG, LPG and LDG, and 8 cooling water.

The tapered region is provided to conduct supersonic injection of the gas, thereby improving a dissolution efficiency of oxygen gas to the molten steel by hard blow and also preventing clogging and further making a flame certainly even if under not more than 50 Torr. Taper (inclination) angle $\theta_1$ of the taper region is preferably 1° to 20°. Below 1°, no supersonic injection is obtained, whereas above 20°, separation phenomena of the gas blow is caused, and the gas injection is in a subsonic state, resulting in a decrease in the discharge flow speed.

In FIG. 1(*c*), $P_1$ is an injection gas pressure at the throat part and $P_2$ is an injection gas pressure at the lower end of the tapered region 3. As the injection gas approaches the lower end of the tapered region 3, the injection gas pressure is lowered. The present top blow lance 1 is so appropriately designed as to inject an oxygen gas or an oxygen-containing gas or together with a fuel gas, under a low pressure, for example, not more than 50 Torr, in a vacuum treatment vessel. Thus, the injection gas pressure at the lower end of the tapered region 3 is less than 1 atom. For example, in case of an oxygen gas injection, it is 10 to 30 Torr and in case of an oxygen gas together with a fuel gas, it is 2 to 10 Torr.

In the top blow lance 1, a ratio of diameters $D_1$ at the lower end of the tapered region to diameter $D_2$ at the upper end (throat) part of the tapered region, i.e. $D_1/D_2$, is preferably 1 to 40. When $D_1/D_2$ is less than 1, no tapered structure is available and no supersonic injection state is obtained, whereas when $D_1/D_2$ is 40 or more, the gas inlet pressure is too high, and the gas injection cannot be commercially carried out.

According to the present inventor's knowledge, a top blow having a taper angle $\theta_1$ of for example 5 to 10° in the taper region and a $D_1/D_2$ of for example 3 to 5 is preferable in FIG. 1(*a*). In case of injecting only an oxygen gas, in a vacuum vessel under a low pressure during a vacuum treatment, the oxygen gas can be injected at a sufficient supersonic speed, and thus the molten steel can be efficiently decarburized. In case of injecting an oxygen gas and a fuel gas together, the oxygen gas and the fuel gas can be thoroughly mixed in the taper region and high temperature flame can be obtained, and at the same time the molten steel and the inside wall of a vacuum treatment vessel can be efficiently heated because of good inflammability of the gas mixture.

In the top blow lance 1, fuel gas supply ports 4 are provided on the tapered side of the tapered region 3. In FIG. 1(*c*), the injection oxygen gas pressure $P_1$ is high at the throat part 2 and thus the fuel gas is supplied under a considerably high pressure. When the fuel gas is supplied under a pressure adjusted to be equal to $P_1$, the combustion will often be unstable and such adjustment will be a troublesome operation. When the fuel gas supply ports 4 are provided at a level corresponding to the lower end of the taper region 3, it is hard to thoroughly mix the fuel gas with the oxygen gas.

When the fuel gas supply ports are provided within a region lower than the position where the pressure of injection gas, i.e. oxygen gas, from the throat part 2 is equal to the discharge pressure of the fuel gas, and higher by 5 mm or more than the lower end of the tapered region, as indicated by S in FIG. 1(*a*), the pressure of injection gas, i.e. oxygen gas, at the level of the fuel gas supply ports will be, for example $P_3$, in FIG. 1(*c*), which is lower than the discharge pressure of fuel gas, the fuel gas can be stably supplied, and also can be combusted stably even if the pressure in the vacuum vessel become not more than 50 Torr. If the fuel gas supply ports are provided on the tapered surface at the position, where is higher by at most 5 mm than the lower end of the tapered region, it becomes a problem that the fuel gas supply ports are clogged due to deposition of splash of molten steel.

Diameter $D_3$ at the lower end part of each of the fuel gas supply ports is designed so as to set in such a manner that the pressure at each of the fuel gas supply ports is higher than that of oxygen gas at each of their positions.

According to the present invention, a fuel gas of a desired flow rate and an oxygen gas or oxygen-containing gas of a flow rate which is needed for combustion of the fuel gas, are supplied from a top bow lance 1. As mentioned in FIG. 1(*c*), the pressure of injected oxygen gas at the lower end of the tapered region of the present top blow lance is small, and thus a tranquil long flame is formed to heat molten steel efficiently.

In FIG. 1(*a*) (*b*), a case of providing two fuel gas supply ports is examplified, but it is preferably to provide at least three fuel gas supply ports in symmetrical positions to the axial center line, because the formed flames become more symmetrical to the axial center line of a top blow lance at positions before and behind as well as right and left the axial center line. The symmetrical positions to the axial center line means positions where angles formed by intersection of straight lines, which pass the center of each of the fuel gas supply port and which cross perpendicularly to the axial center line of the top blow lance 1, are equal to one another.

In the present invention, the top blow lance is provided at the top of a vacuum treatment vessel in a freely upward and downward movable manner.

Figure 2B:
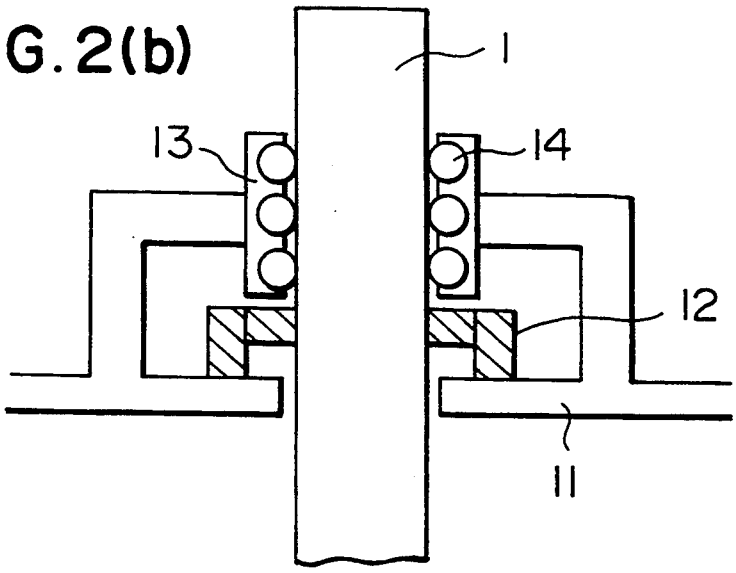

FIGS. 2(*a*) and 2(*b*) are schematic, vertical cross-sectional views showing the arrangement and supporting to the present top blow lance and particularly applied to an RH vacuum degassing apparatus as a typical treatment apparatus. As shown in FIG. 2(*a*), a top blow lance 1 is vertically provided at the top of a vacuum treatment vessel 9 so as to upward and downward move in the vacuum treatment vessel 9, as shown by an arrow 10. FIG. 2(*b*) is a schematic view showing providing the top blow lance 1 through the top of the vacuum treatment vessel in a sealed stage. For example, a seal clamp 12 is gas-tightly provided at the steel casing 11 at the top of the vacuum treatment vessel 9. Numeral 13 is a roller support. For example, the top blow lance 1 is set to a desired position by loosening the clamping force of the seal clamp 12, and rotating the rollers 14 of the roller support 13, thereby upward and downward moving the top blow lance 1. Then, the clamping force of the seal clamp 12 is increased to gas-tightly hold the top blow lance 1 by the seal clamp 12. For example, the top blow lance 1 is gas-tightly kept at a desired level and vertically moved in the vacuum treatment vessel through these operations. In FIG. 2(*a*), numeral 15 is a ladle, 16 molten steel, 17 a gas blowing hole for reflux, and 18 an exhaust pipe connected to a vacuum evacuation system.

As shown in FIG. 1(*a*), in the present top blow lance, a decarburization treatment by single oxygen injection can be carried out by discontinuing supply of the fuel gas 7 and by injecting only the oxygen gas or oxygen-containing gas 6 alone. When decarburization and heating of molten steel are carried out at the same time by oxygen gas injection, a large amount of oxygen gas from the throat part 2 and a desired amount of the fuel gas from fuel gas supply ports 4 must be supplied at the same time. In the tapered region, the pressure is gradually lowered. When the pressure of injection gas, i.e. oxygen gas, at the level of the fuel gas supply ports 4 is lower than the discharge pressure of the fuel gas, a desired amount of the fuel gas can be supplied from the fuel gas supply ports 4 at the same time without any trouble. At that time, a portion of the supplied oxygen gas is used for combustion of the fuel gas, and the resulting heat of combustion showers on the molten steel, thereby heating the molten steel and the inside wall of the vacuum treatment vessel, while the remaining portion of oxygen is used for decarburization of the molten steel in the vacuum degassing vessel.

The present inventors have found that it is very economical and useful that a heating, which is carried out in order to elevate a temperature of the molten steel and/or prevent a deposition of molten steel on the inside wall of a vacuum treatment vessel, is conducted positively in such a region that a pressure in the vacuum treating vessel is not more than 50 Torr.

Figure 3:
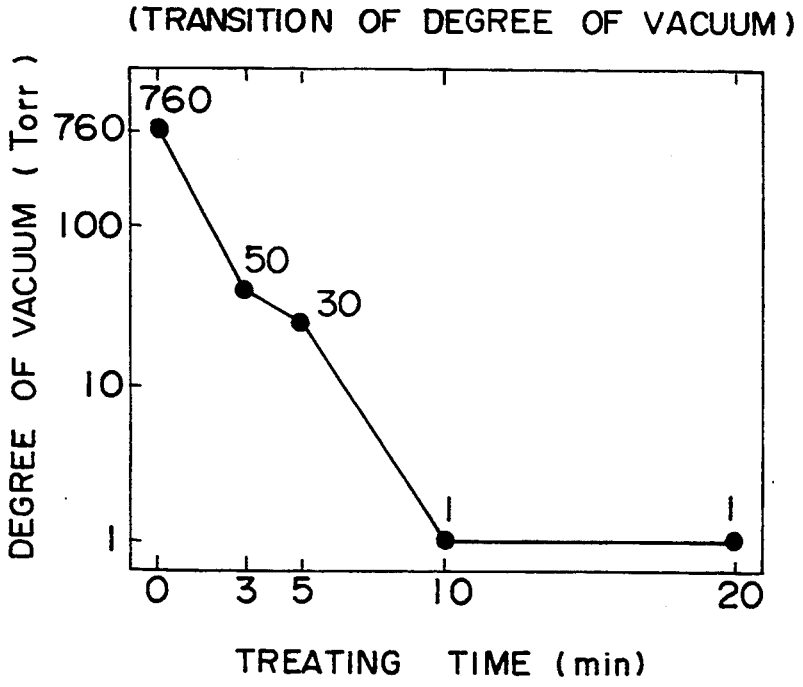
FIG. 3 is a diagram showing relationship between the treating time and the degree of vacuum.

FIG. 3 shows relationship between the pressure in the RH vacuum treatment vessel and the treating time with respect to a vacuum degassing treatment on a dehydrogenized steel species. After the vacuum degassing treatment is started, the degree of vacuum reaches 300 Torr after 1 minutes and a reflux of molten steel starts. It reaches 50 Torr after 3 minutes, 30 Torr after 5 minutes and 1 Torr after 10 minutes. The total of the treating time is 20 minutes. It can be seen that in this case, the treating time takes only 2 minutes from 300 Torr, at which the reflux of molten steel starts, to 50 Torr, whereas it takes 18 minutes in the region of not more than 50 Torr, which are about 9 times as long as the said treating time.

When the present top blow lance is used, it is possible to form a flame stably even if in the region of not more than 50 Torr. For example, in the RH vacuum treatment vessel which treats 100 ton of molten steel, an oxygen and a fuel gas (LNG: 114 $Nm^3/hr$) were injected from the present top lance and were burnt for a period of from 300 Torr, at which the reflux of molten steel starts, to the completion of the vacuum degassing treatment. The drop of the temperature obtained for 2 minutes from 300 Torr to 50 Torr is by only 1° C. for the temperature improvement, as compared with the case that the combustion treatment is not carried out. On the other hand, when the combustion treatment is carried out in a region of from 50 Torr to the completion of the vacuum degassing treatment, the temperature improvement is achieved as much as 9° C., as compared with the case of no combustion treatment.

When the temperature of the molten steel is elevated by heating by use of the present top blow lance during the vacuum degassing treatment, if the reflux of molten steel does not start, that is, if the molten steel is not sucked up into the vacuum degassing treatment vessel, the temperature of the molten steel cannot be elevated. And thus, if the fuel gas is burnt for a period of from the pressure (300 Torr), at which the reflux of molten steel starts, to the completion of the vacuum degassing treatment, the temperature of the molten steel can be elevated to the maximum.

The present invention is very economical because the molten steel is heated by burning the fuel gas in the state that the pressure in the vacuum degassing treatment vessel is not more than 50 Torr, and thereby the temperature of the molten steel can be elevated at the same time with the degassing treatment or at the same time with the composition adjustment treatment which is carried out in the reflux treatment after the degassing treatment, and further the region of not more than 50 Torr where the treatment time is long is used.

According to the present invention, it is possible to burn the fuel gas in the state that the pressure in the vacuum degassing treatment vessel is not more than 50 Torr and thereby to heat the molten steel or the inside wall of the vacuum treatment vessel in order to prevent a deposition of the molten steel thereon. In this case, it is desirable to keep the lower end of a top blow lance at a level of 1.0 m or more from the surface of a molten steel bath. Because a formation of a flame depends on an amount of a fuel supplied to a lance and the flame, which is formed in the case that a fuel gas is burnt at not less than 50 Torr, is formed from about 1.0 m downward apart from the lower end of the top blow lance in condition of, for example, 114 $Nm^3/hr$ of LNG.

Figure 4A:
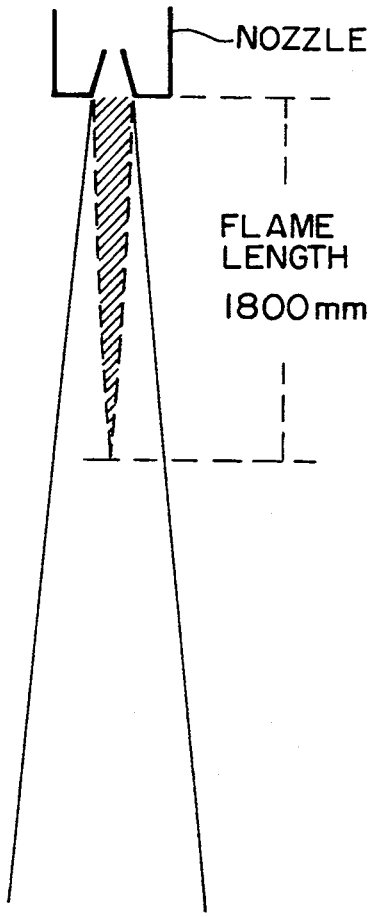
FIG. 4(*a*) is a schematic vertical cross-sectional view showing a state of a flame of oxygen gas injected from the top blow lance under the atmospheric pressure, and FIG. 4(*b*) is a schematic vertical cross-sectional view showing a state of a flame of oxygen gas injected from the top blow lance under vacuum.
Figure 4B:
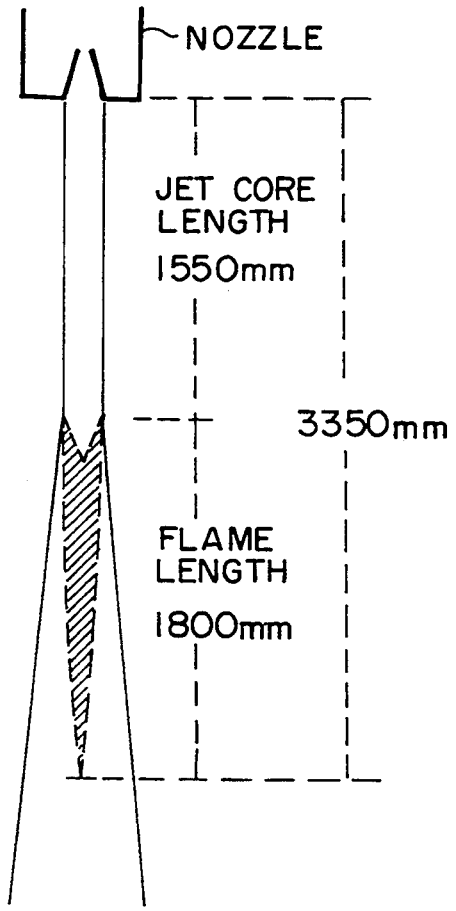

Because the state of flame formed at a low pressure in the vacuum vessel cannot be observed, the result of simulation of the flame formation is shown in FIGS. 4(*a*) and 4(*b*). FIGS. 4(*a*) and 4(*b*) show simulations in the case that 228 $Nm^3/hr$ of LNG and 508 $Nm^3/hr$ of oxygen gas are supplied to the top blow lance shown in the later-mentioned examples and they are burnt, and FIG. 4(*a*) is a case of combustion under the atmospheric pressure and 4(*b*) is a case of combustion at 5 Torr. From this result, it can be seen that the flame is formed from about 1.5 m downward apart from the lower end of the top blow lance under the reduced pressure and in condition of 228 $Nm^3/hr$ of LNG.

In practice, in order to elevate the temperature of a molten steel, it is preferable to arrange the lower end of a top blow lance at a level of 2 to 5 m from the surface of a molten steel bath, further preferably, about 4 m therefrom.

Figure 5:
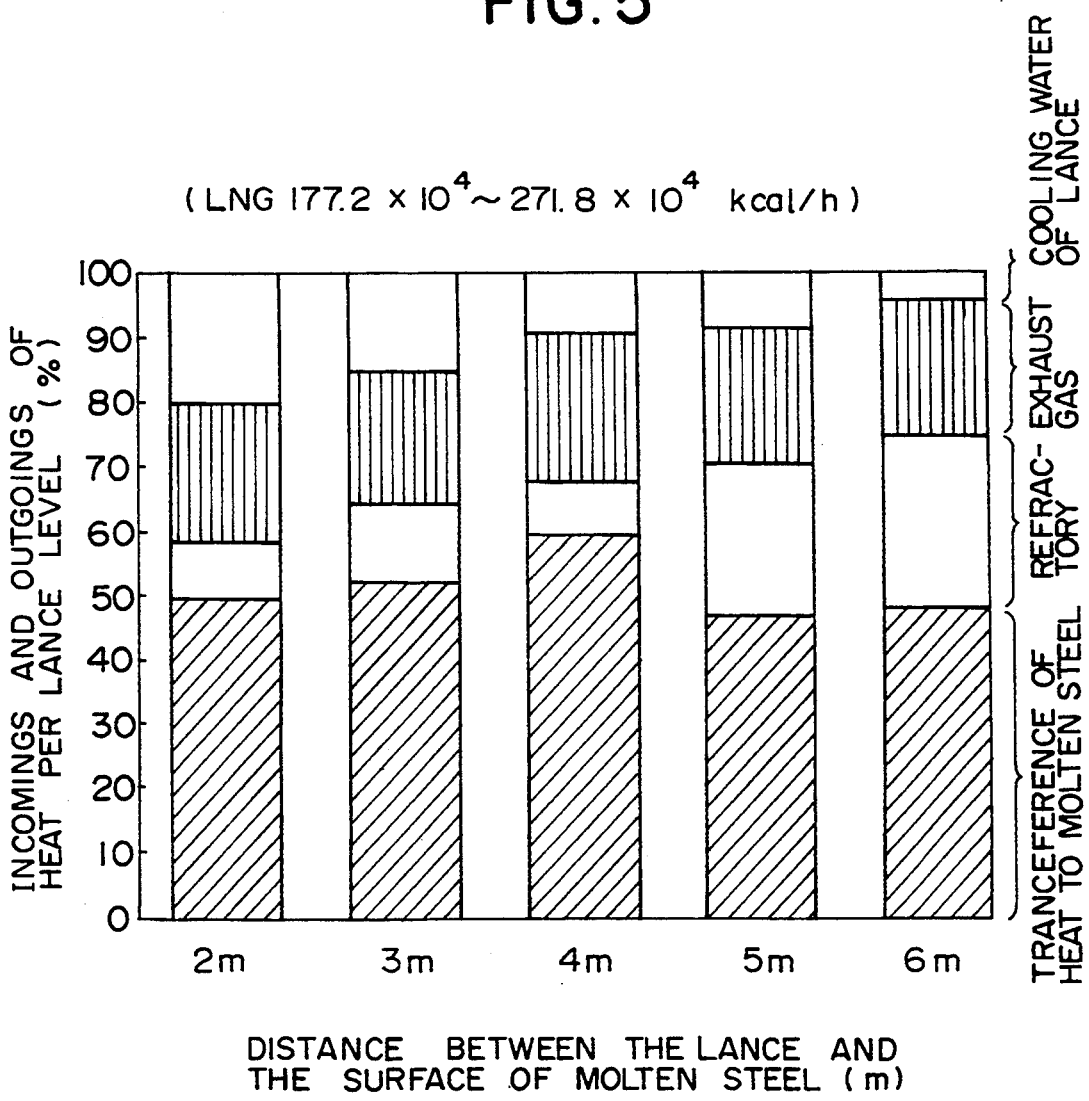
FIG. 5 is a diagram showing what percent of the combustion heat generated in the case of each lance level is consumed at what portion.

FIG. 5 is a diagram showing what percent of the combustion heat is consumed by what portion, when the present top blow lance shown in the example is inserted in the RH vacuum treatment vessel, which treats 100 ton of molten steel, in a state that the pressure therein is not more than 5 Torr, and a fuel gas (LNG: 228 $Nm^3/hr$) and an oxygen gas (508 $Nm^3/hr$) are injected therein therefrom and they are burnt in the case that the present top blow lance is arranged at a level of each of 2 m, 3 m, 4 m, 5 m and 6 m from the surface of a molten steel bath. A transference of heat to the molten steel, a transference of heat to the cooling water for the lance, a transference of heat to the exhaust gas and a transmission of heat to the refractory are calculated as follows.

A transference of heat to the molten steel:

A temperature of the molten steel which is in process of heating by a burner is measured by a method for measuring a temperature by a platinum thermocouple probe which is usually used. A temperature change in the case that the heating of the burner is not conducted is measured as a comparison, and it was determined that the difference between the both is determined as an amount of compensation of the temperature of the molten steel. Therefore, a product of an amount of compensation of the temperature of the molten steel, an amount of the molten steel and a specific heat of the molten steel is determined as a quantity of heat which is transferred to the molten steel.

A transference of heat to the cooling water for the lance: A difference of temperatures at an inlet side and an outlet side of the cooling water for the lance under heating by a burner is measured and a product of a difference of those temperatures, a quantity of the cooling water and a specific heat of water is determined as a quantity of heat transferred to the cooling water.

A transference of heat to the exhaust gas: With respect to a transference of heat to the exhaust gas, a flow rate of the exhaust gas, its temperature and its composition are measured, and a product of a specific heat, which is presumed from the composition, a flow rate of the exhaust gas and the temperature is determined as an amount of the heat transmission. The amount of the exhaust gas is calculated from the material balance of C component. Specifically, a flow rate of LNG, which is a fuel gas, and a flow rate of C, which generates from the change of C in the molten steel, are calculated while a ratio of C is calculated from the concentrations of CO and $CO_2$ in the exhaust gas, and thereby the total flow rate of the exhaust gas is calculated from the aforementioned flow rate of C and the ratio of C.

A transmission of heat to the refractory: A combustion rate of LNG, which is injected by a burner, is calculated from the composition of the exhaust gas and further an amount of generated heat is calculated. This value is a total of the amount of generated heat, and it is considered that the rest, which is obtained by subtracting the transference of heat to the molten steel, the transference of heat to the cooling water for the lance, the transference of heat to the exhaust gas from this value, is the transmission of heat to the refractory.

From this result, it can be seen that when it is desirous to elevate the temperature of the molten steel, it is preferable to arrange the lower end of the top blow lance at a level of 2 to 5 m upward apart from the surface of the molten steel bath, further preferably, about 4 m therefrom.

In the result of the simulation, the lower end of the flame is situated at about 3.3 m downward apart from the lower end of the top blow lance, and thus it is considered that when the surface of the molten steel bath is arranged in that situation, the temperature of the molten steel can be most efficiently elevated.

When the heating of the inside wall of the vacuum treatment vessel is conducted to prevent a deposition of molten steel thereon, it is preferable that the fuel gas is burnt in such a manner that the top blow lance is elevated as much as possible. Because the combustion heat, which is taken away by the top blow lance itself, must be suppressed to the utmost. This can be seen from the result shown in FIG. 5.

In vacuum dehydrogenation treatment of deoxidized steel, etc., the lower end of the top blow lance is arrange at a distance of 1.0 m or more from the surface of molten steel and both oxygen gas or oxygen-containing gas and fuel gas are injected in the vacuum vessel from the top blow lance to conduct combustion and heat generation therein, and furthermore while the vacuum treatment vessel is standby for the vacuum degassing treatment, both oxygen gas or oxygen-containing gas and fuel gas are injected from the top blow lance therein to conduct combustion and heat generation in the vacuum vessel to keep the wall surface of the vacuum vessel at a high temperature and elevate the temperature of molten steel by the heat transfer due to radiation.

Figure 6:
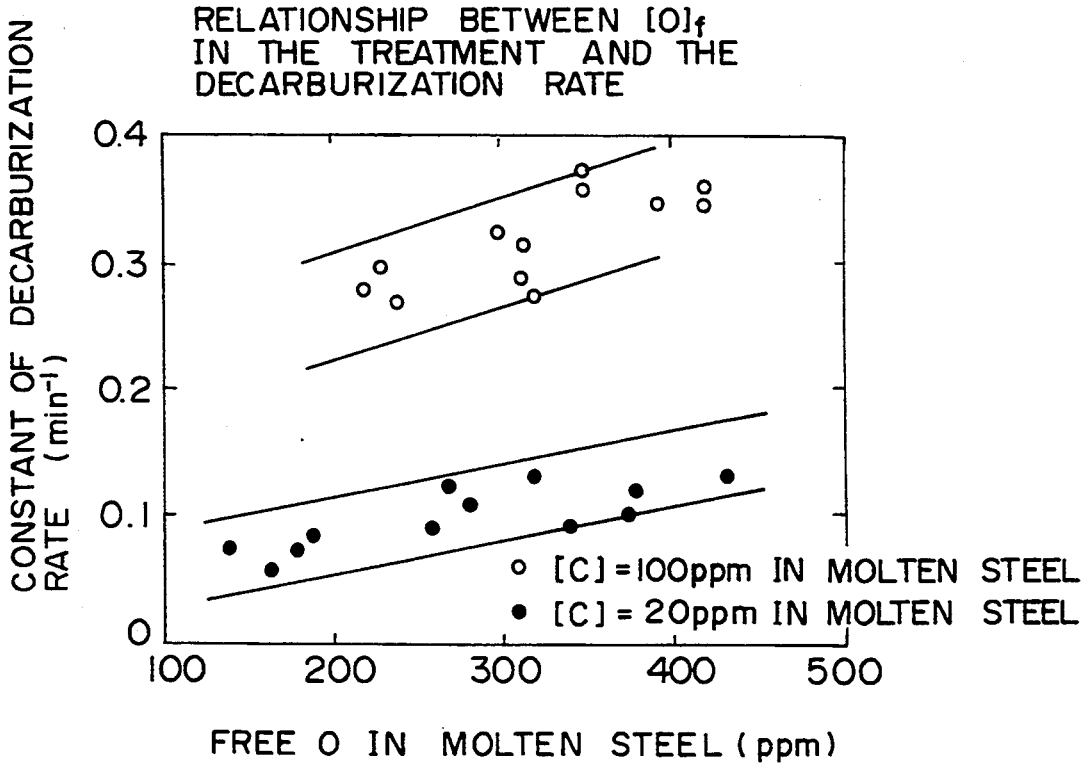
FIG. 6 is a diagram showing relationship between the concentration of oxygen in molten steel and the decarburization rate.

Furthermore, the present inventors have found that the decarburization can be promoted by increasing the oxygen concentration of the molten steel. FIG. 6 shows relationship between the oxygen concentration of molten steel and the decarburization rate, where mark "○" shows that the carbon concentration is 100 ppm and mark "●" shows that it is 20 ppm.

In FIG. 6, the constant of decarburization rate is defined by the following formula:

$$\text{Constant of decarburization rate} = \frac{l_n([C]_1/[C]_2)}{t_2 - t_1}$$

wherein ln is natural logarithm, $[C]_1$ is [C] at the time of time $t_1$, $[C]_2$ is [C] at the time of time $t_2$, a decarburization rate at the time of [C]=100 ppm is shown in the figure by a decarburization rate which passes through 100 ppm, and a decarburization rate at the time of [C]=20 ppm is shown in the figure by a decarburization rate which passes through 20 ppm.

As is evident from FIG. 6, the decarburization rate is accelerated by increasing the oxygen concentration. On the other hand, the present inventors have also found that the pressure in the vacuum treatment vessel is increased by continuously injecting the oxygen gas from the top blow lance to supply to oxygen gas, and the vacuum degassing rate itself is lowered. In order to promote the decarburization by injecting only an oxygen gas to the molten steel from the top blow lance, it is necessary that the lower end of the top blow lance is made to approach the surface of molten steel bath and the oxygen gas is intensively supplied into the molten steel within a short time and thereafter the oxygen gas injection is discontinued.

In the present invention, only the oxygen gas is injected to the molten steel from the top blow lance at a distance H of not more than 2 m between the lower end of the top blow lance and the surface of molten steel bath, as shown in FIG. 2(*a*), (The distance will be hereinafter referred to as lance level), thereby promoting the carburization.

Figure 7:
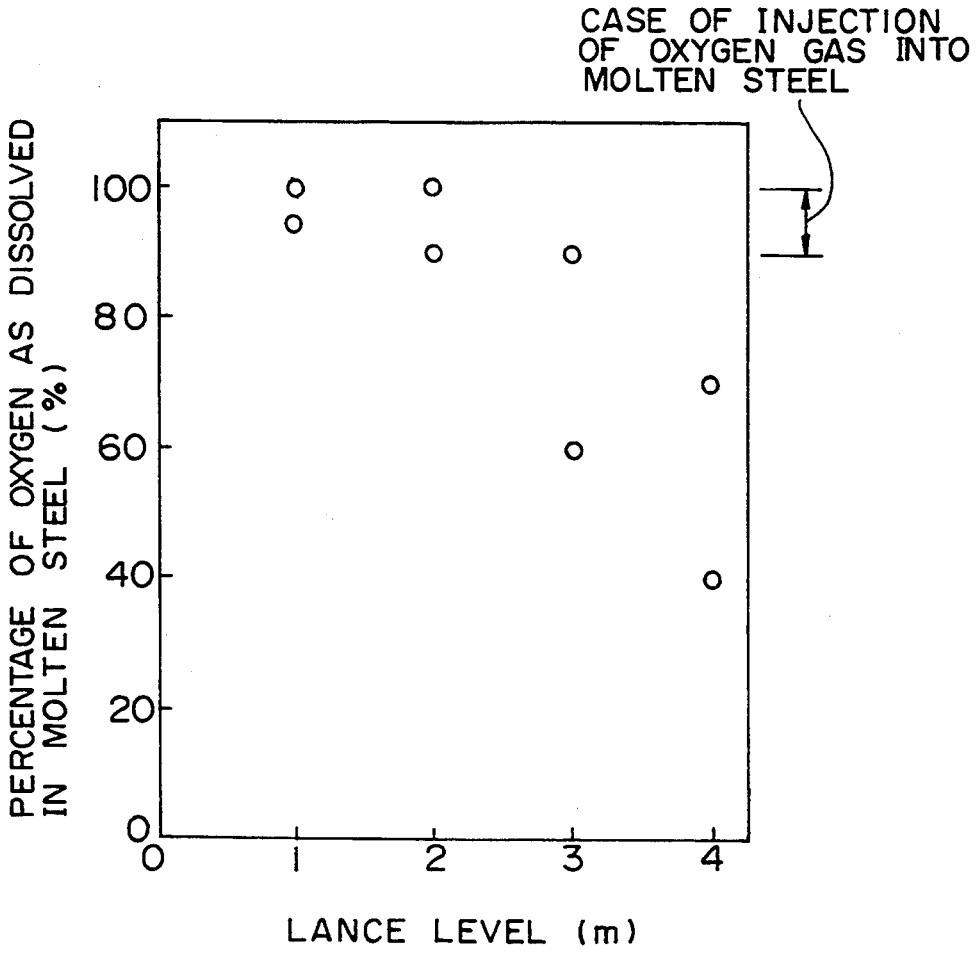
FIG. 7 is a diagram showing relationship between the lance level and the percentage of oxygen injected from the top blow lance as dissolved in molten steel.

FIG. 7 shows relationship between the lance level and the percentage of top blown oxygen gas dissolved in molten steel. In FIG. 7, when the lance level is not more than 2 m, the percentage of top blown oxygen as dissolved in the molten steel is substantially equal to the percentage in the case of oxygen as directly injected in the molten steel under the surface of the molten steel, when the lance level is not more than 2 m, whereby the oxygen concentration of molten steel can be rapidly increased. In addition, when the percentage of top blown oxygen as dissolved in the molten steel is substantially equal to the percentage in the case of oxygen as directly injected in the molten steel, the lance level may be more than 2 m.

Therefore, when a deoxidized molten steel is subjected to a vacuum degassing treatment to smelt deoxidized steel species (a thich plate etc.), it is sufficient only to heat the molten steel by burning the fuel gas at the same time of the vacuum degassing treatment. On the other hand, when an undeoxidized molten steel is decarburized by the vacuum degassing treatment thereby to smelt low carbon steel species, it is desirable to conduct the treatment of the following two steps: the first step in which the lower end of the present top blow lance is arranged at a distance of not more than 2 m from the surface of molten steel bath, and only oxygen gas is injected to the molten steel from the top blow lance thereby to conduct a decarburization treatment effectively; and successively the second step in which the lower end of the top blow lance is arranged at a level of, for example, 1.0 m or more in the case of 114 $Nm^3/hr$ or more of LNG or 1.5 m or more in the case of 228 $Nm^3/hr$ or more from the surface of the molten steel bath, and the fuel is burnt to thereby to heat the molten steel and/or refractory of the inside wall of the vacuum treatment vessel under vacuum (this period is arranged at most cases for a dehydrogenation or a composition adjustment treatment).

When the low carbon steel species are smelt, the treatment is carried out by two steps composed of the decarburization and the heat due to flame as mentioned above. And thus it has been so far presumed that, when only an oxygen gas is injected to molten steel at a lance level of not more than 2 m, the molten steel would splash vigorously in the vacuum treatment vessel and the molten steel would deposit on the inside wall of the vacuum treatment vessel. However, the present inventors have found that no deposition of molten steel on the inside wall takes place, if the surface of refractory in the vacuum treatment vessel is kept at a high temperature by the flame under vacuum.

The timing of discontinuing the injection of oxygen differs according to a specification of molten steel to be produced and a condition of the RH vacuum degassing treatment. However, in general, an operation for injecting oxygen gas is conducted in the case of shortage of oxygen from the relationship between the oxygen and carbon concentrations before the treatment. And thus, in order to treat a molten steel smelted under the condition of a usual top and bottom blow converter, the timing of discontinuing is set at the time, for example, when a carbon concentration reaches 0.02 to 0.005 wt. %, for example, when it reaches 0.01 wt. %.

In addition, when heating by flame is conducted under vacuum, after the decarburization, it is preferable that the deoxidation treatment is carried out by using Al etc. subsequently to the decarburization treatment. Because when the fuel is burnt before the deoxidation treatment, the vacuum degree is somewhat deteriorated thereby to decrease the effect of the degassing treatment.

However, for example, when the temperature of molten steel is low before the vacuum degassing treatment and no target temperature can be obtained by the heat generated by combustion of the fuel gas with the oxygen gas or the oxygen-containing gas from the top blow lance after the deoxication treatment, it is possible to conduct combustion of the fuel gas with the oxygen gas from the top blow lance even in the latter half period of decarburization treatment successive to the injection of the oxygen gas in the decarburization period.

In addition, it is considered that an action and an effect, which are obtained by injecting $O_2$ and LNG in the deoxidation treatment after the decarburization treatment, are equal to those, which are obtained by injecting $O_2$ and LNG in the dehydrogenation treatment shown in the examples (Table 2).

As described in the foregoing, after the decarburization treatment is over, and when the lower end of the top blow lance is arranged at a lance level of 1.0 m or more from the surface of molten steel bath and both oxygen gas or oxygen-containing gas and fuel gas are injected from the top blow lance to conduct combustion of the fuel gas in the vacuum treatment vessel and generate heat therein in the deoxidation and composition adjustment steps, the decarburization and the rise of heat of molten steel can be efficiently made and the deposition of molten steel can be prevented. And furthermore, when both oxygen gas or oxygen-containing gas and fuel gas are also injected in the vacuum treatment vessel from the top blow lance to conduct combustion and generate heat therein while standing by for the purpose of the vacuum degassing treatment, the wall surface of the vacuum treatment vessel can be kept at a high temperature. Still furthermore, when the lance level is set to 1.0 m or more, or adjusted in a range of 1.0 m or more by upward and downward moving the to blow lance, the temperature distribution in the vertical direction of the inside wall of the vacuum treatment vessel can be made uniform to prevent deposition of molten steel at every positions in the vessel.

Heating of the inside wall of the vacuum treatment vessel in being on standby or dissolution and removal of deposited molten steel are often carried out under the atmospheric pressure. When the top blow lance shown in FIG. 1(*a*) is used under the atmospheric pressure, the lower end of the tapered region can be kept under the atmospheric pressure. Thus, the gases once injected from the lower end of the tapered region can be mixed much better.

As a result, a much higher temperature flame with a length shorter than under a reduced pressure can be formed. The inside wall of vacuum treatment vessel is heated by the heat of radiation from the much higher temperature flame and the deposited steel is melted away by the heat of radiation from the much higher temperature flame. In the present invention, the top blow lance can be moved upward and downward. By forming a much higher temperature flame with a shorter length than under a reduced pressure and upward and downward moving the top blow lance to correspondingly move the much higher temperature flame in the upward and downward direction, the deposited steel near the flame is melted away and thus the deposited steel on the inside wall of the vacuum treatment vessel can be more efficiently removed.

In the foregoing, the present invention has been explained, referring to the vacuum decarburization treatment of molten steel according to the RH degassing process. The present invention can be also applied to other vacuum decarburization treatments according to a DH degassing process, a VOD (vacuum oxygen decarburization) degassing process, etc. with the same effect as that of the RH degassing process.

PREFERRED EMBODIMENTS OF THE INVENTION

Examples

Molten steel produced in a 100-ton converter having the following composition was subjected to a decarburization treatment under the conditions shown in Table 1 or to a degassing treatment under the conditions shown in Table 2 in a 100-ton RH vacuum degassing apparatus having a top blow lance shown in FIGS. 1(*a*) and 1(*b*).

Composition

C: 0.032–0.051 wt. %

O: 0.0216–0.0355 wt. %

In the present examples, even in being on standby such that the molten steel is not subjected to the RH vacuum degassing treatment, and oxygen gas and LNG were injected in the vacuum treatment vessel from the top blow lance and were burnt therein, thereby to heat the inside of the vacuum treatment vessel and keep the temperature in the vessel in a heated state. The lance used in the examples had the following demensions:

Throat diameter $D_2$: 17 mm$\phi$

Outlet diameter $D_1$: 81 mm$\phi$

Length of tapered region: 225 mm

Taper angel of tapered region $\theta_1$: 8°

Diameter of each of 3 fuel gas supply ports $D_3$: 11.5 mm$\phi$

Length of the tapered region from the lower end of tapered region to the fuel gas supply port: 107 mm Inclination angle of fuel gas supply port $\theta_2$:15°

In Table 1, Run Nos. 1 and 2 are examples of the present invention directed to decarburized steel species, where in the first period of decarburization treatment, the lance was lowered and only oxygen gas was injected for a short time, and successively the oxygen gas and LNG were injected to burn LNG until the time of the RH vacuum degassing treatment was completed. Temperature decrease could be considerably prevented during the RH vacuum degassing treatment, as compared with Run No. 8 (Comparative Example), where no gas injection was made, and there was substantially no deposition of molten steel on the inside wall of the vacuum treatment vessel. The ultimate [C] (C content) was lowered. That is, the decarburization was effectively promoted.

On the other hand, a test was carried out to find effect of secondary combustion on heat generation and decarburization promotion by conducting oxygen injection in the first half period of the decarburization treatment, as shown in Run No. 9 (Comparative Example). Makeup (Compensatory) temperature for molten steel calculated from the decarburization value and the secondary combustion value was about 3° C., and the test result also revealed that the makeup temperature was small. The amount of heat generation was small throughout and deposition of molten steel on the inside wall of the vacuum treatment vessel could not be completely eliminated.

In Table 1, Run Nos. 3 to 7 are examples of the present invention, directed also to decarburized steel species, where the lance was lowered in the first period of decarburization treatment, and only oxygen gas was injected for a short time, and in the decarburization step which is successive further after the completion of the oxygen gas injection, the gas injection was discontinued from the lance, and after the deoxidation treatment both oxygen gas and LNG were again injected to combust LNG until the time of the RH vacuum degassing treatment was completed. The decarburization was promoted and the ultimate C content was remarkably lowered. Temperature decrease could be prevented during the RH treatment, as compared with Run No. 8 (Comparative Example) where any gas injection was not conducted at all and Run No. 9 where only oxygen gas was injected in the initial period of decarburization treatment, and there was substantially no deposition of molten steel on the inside wall of the vacuum treatment vessel.

In Table 2, Run Nos. 1 to 5 are examples of vacuum degassing treatment for the purpose of dehydrogenation according to the present invention directed to deoxidized molten steel, where both oxygen gas and LNG were injected from the lance and LNG was burnt until the time of the RH vacuum degassing treatment was completed. Temperature decrease could be prevented during the RH vacuum degassing treatment, as compared with Run No. 6 (Comparative Example) where any gas injection was not conducted at all, and there was substantially no deposition of molten steel on the inside wall of the vacuum treatment vessel and there was no difference in usefullness with respect to the achievable level of dehydrogenation.

TABLE 1

RH treatment time: 28 min. (fixed), in which decarburization time is 19 min.

| | Run No. | Concentration before treatment (ppm) [C] | [O] | Temp. before treatment (°C.) | Single oxygen injection: Lance level (m) | Time (min) Start | End | Pressure change in vessel (Torr) | Oxygen flow rate ($Nm^3$/hr) | Oxygen and fuel gas injection: Lance level (m) | Time (min) Start | End | Pressure change in vessel (Torr) | Flow rate ($Nm^3$/hr) $O_2$ | LNG |
|---|---|---|---|---|---|---|---|---|---|---|---|---|---|---|---|
| The Invention | 1 | 420 | 255 | 1610 | 1.5 | 0.5 | 5 | 300–40 | 1000 | 3.0 | 5 | 28 | 40–0.5 | 254 | 114 |
| | 2 | 435 | 230 | 1608 | 2.0 | 0.5 | 6 | 300–35 | 1000 | 2.0 | 6 | 28 | 35–1 | 254 | 114 |
| | 3 | 494 | 225 | 1605 | 2.0 | 0.5 | 5 | 300–40 | 1000 | 3.0 | 19 | 28 | 10–1 | 254 | 114 |
| | 4 | 421 | 237 | 1612 | 2.0 | 0.5 | 6 | 300–35 | 1000 | 2.0 | 19 | 28 | 10–0.5 | 254 | 114 |
| | 5 | 510 | 216 | 1620 | 2.0 | 0.5 | 5 | 300–40 | 1000 | 1.5 | 19 | 28 | 10–1 | 254 | 114 |
| | 6 | 482 | 256 | 1613 | 2.0 | 0.5 | 5 | 300–40 | 1000 | 2–4 | 19 | 28 | 10–1 | 254 | 114 |
| | 7 | 485 | 290 | 1615 | 2.0 | 0.5 | 6 | 300–35 | 1000 | 1.0 | 19 | 28 | 10–1 | 254 | 114 |
| Comp. Ex. | 8 | 320 | 355 | 1610 | — | — | — | — | — | — | — | — | — | — | — |
| Comp. Ex. | 9 | 453 | 251 | 1608 | 3.0 | 0.5 | 6 | 300–40 | 1000 | — | — | — | — | — | — |

| | Run No. | Molten Steel temp. after the treatment (°C.) | Temp. decrease during the treatment (°C.) | Ultimate C content (ppm) | Deposition of molten steel in vacuum vessl: Bottom | middle | Top | Deterioration of lance tip end | Remark |
|---|---|---|---|---|---|---|---|---|---|
| The | 1 | 1592 | 18 | 13 | ◎ | ◎ | ◎ | No damage | |

TABLE 1-continued

| | | | | | | | | | |
|---|---|---|---|---|---|---|---|---|---|
| RH treatment time: 28 min. (fixed), in which decarburization time is 19 min. | | | | | | | | | |
| Invention | 2 | 1589 | 19 | 14 | ○ | ◎ | ◎ | No damage | |
| | 3 | 1581 | 24 | 11 | ○ | ◎ | ○ | No damage | |
| | 4 | 1589 | 23 | 10 | ◎ | ○ | ○ | No damage | |
| | 5 | 1598 | 22 | 9 | ◎ | ○ | ○ | No damage | |
| | 6 | 1598 | 22 | 9 | ◎ | ◎ | ◎ | No damage | 19 min thereafter, the lance was moved upward and downward in a range of 2 to 4 m. |
| | 7 | 1590 | 25 | 11 | ◎ | ○ | ○ | Sligh damage | |
| Comp. Ex. | 8 | 1580 | 35 | 17 | X | X | X | | |
| Comp. Ex. | 9 | 1575 | 33 | 13 | Δ | X | X | No damage | |

◎ No deposition
○ Slight deposition
Δ Moderate deposition
X Heavy deposition

TABLE 2

| | | | | | | | | |
|---|---|---|---|---|---|---|---|---|
| RH treatment time: 19 min. (fixed) | | | | | | | | |
| | | | Oxygen + fuel gas injection | | | | | |
| | Run No. | Temperature before treatment (°C.) | Lance level (m) | Time (min) Start | Time (min) End | Pressure change in vessel (Torr) | Flow rate ($Nm^3/hr$) $O_2$ | Flow rate ($Nm^3/hr$) LNG |
| The Invention | 1 | 1603 | 1.5 | 0.5 | 19 | 300–0.5 | 254 | 114 |
| | 2 | 1599 | 3.0 | 0.5 | 19 | 300–0.5 | 254 | 114 |
| | 3 | 1610 | 4.5 | 0.5 | 19 | 300–0.5 | 254 | 114 |
| | 4 | 1615 | 3.0 | 0.5 | 19 | 300–1 | 508 | 228 |
| | 5 | 1612 | 1.0 | 0.5 | 19 | 300–0.5 | 254 | 114 |
| Comp. Ex. | 6 | 1604 | — | — | | — | — | — |

| | Run No. | Molten Steel temp. after treatment (°C.) | Temp. decrease during treatment (°C.) | Deposition of molten steel on inside wall of vacuum vessel | Deterioration of lance tip end | [H] (ppm) Before treatment | [H] (ppm) After treatment |
|---|---|---|---|---|---|---|---|
| The Invention | 1 | 1583 | 20 | ◎ | No damage | 6.0 | 0.9 |
| | 2 | 1576 | 23 | ◎ | No damage | 5.5 | 0.8 |
| | 3 | 1588 | 22 | ◎ | No damage | 6.2 | 1.0 |
| | 4 | 1603 | 12 | ◎ | No damage | 6.5 | 1.1 |
| | 5 | 1591 | 21 | ◎ | Slight damage | 4.9 | 0.7 |
| Comp. Ex. | 6 | 1574 | 30 | X | | 5.4 | 0.9 |

◎ No deposition
○ Slight deposition
Δ Moderate deposition
X heavy deposition

We claim:

1. A process for vacuum degassing molten steel during a vacuum treatment of the molten steel, said process comprising:

providing a top blow lance, capable of injecting oxygen or an oxygen-containing gas and of injecting a gaseous fuel, respectively, on the top of a vacuum treatment vessel; and with the lower end of the top blow lance located a distance of 1.0 m or more from the surface of a molten steel bath in the treatment vessel, injecting both the oxygen or oxygen-containing gas and the gaseous fuel in the vacuum treatment vessel under a pressure in the vacuum treatment vessel of not more than 50 Torr during the vacuum treatment of the molten steel to burn the gaseous fuel and thereby heat the molten steel.

2. A process for vacuum degassing molten steel during a vacuum treatment of the molten steel, said process comprising:

providing a top blow lance, capable of injecting oxygen or an oxygen-containing gas and of injecting a gaseous fuel, respectively, on the top of a vacuum treatment vessel; and;

with the lower end of the top blow lance located a distance of 1.0 m or more from the surface of a molten steel bath in the treatment vessel, injecting both the oxygen or oxygen-containing gas and the gaseous fuel in the vacuum treatment vessel beginning when the pressure in the vacuum treatment vessel is lower than a pressure in the vessel when a reflux of the molten steel starts and until the vacuum degassing of the molten steel is completed to burn the gaseous fuel and thereby heat the molten steel.

3. A process for vacuum degassing molten steel during a vacuum treatment of the molten steel, said process comprising:

providing a top blow lance, capable of ingecting oxygen or an oxygen-containing gas and of injecting a gaseous fuel, respectively, on the top of a vacuum treatment vessel, the blow lance being supported so as to be movable upwardly and downwardly relative to the vacuum treatment vessel;

while the lower end of the top blow lance is spaced not more than 2 m from the surface of a molten steel bath in the vacuum treatment vessel, injecting only oxygen into the molten steel from the top blow lance to decarburize the molten steel; subsequently spacing the lower end of the top blow lance 1.0 m or more from the surface of the molten steel bath; and while the lower end of the top blow lance is located 1.0 m or more from the surface of the molten steel bath, injecting both the oxygen or oxygen-containing gas and the gaseous fuel in the vacuum treatment vessel to burn the gaseous fuel and thereby heat the molten steel.

4. A process for vacuum degassing molten steel during a vacuum treatment of the molten steel, said process comprising:

providing a top blow lance, capable of injecting oxygen or an oxygen-containing gas and of injecting a gaseous fuel, respectively, on the top of a vacuum treatment vessel, the blow lance being supported so as to be movable upwardly and downwardly relative to the vacuum treatment vessel;

while the lower end of the top blow lance is spaced not more than 2 m from the surface of a molten steel bath in the vacuum treatment vessel, injecting only oxygen into the molten steel from the top blow lance to decarburize the molten steel;

subsequently carrying out a deoxidation treatment of the molten steel and spacing the lower end of the top blow lance 1.0 m or more from the surface of the molten steel bath; and while the lower end of the top blow lance is spaced 1.0 m or more from the surface of the molten steel bath, injecting both the oxygen or oxygen-containing gas and the gaseous fuel in the vacuum treatment vessel to burn the gaseous fuel and thereby heat the molten steel.

5. A process for vacuum degassing molten steel, comprising:

providing a top blow lance, capable of injecting oxygen and a gaseous fuel, respectively, on the top of a vacuum treatment vessel, the blow lance being supported so as to be movable in upward and downward directions relative to the vacuum treatment vessel;

while the lower end of the top blow lance is spaced not more than 2 m from the surface of a molten steel bath, injecting only oxygen into the molten steel from the top blow lance to effect a decarburization of the molten steel;

while the lower end of the top blow lance is spaced 1.0 m or more from the surface of the molten steel bath, injecting both the oxygen and the gaseous fuel in the vacuum treatment vessel from the top blow lance to burn the gaseous fuel and thereby heat the molten steel.

6. A process according to claim 5, wherein the injecting of only the oxygen comprises injecting only oxygen into an undeoxidized molten steel until the carbon content of the molten steel reaches a desired value.

7. A process according to claim 6, wherein the injecting of the oxygen into the undeoxidized molten steel is discontinued when the carbon content of the molten steel reaches 0.02 to 0.005% by weight.

8. A process according to claim 7, wherein the injecting of the oxygen into the undeoxidized molten steel is discontinued when the carbon content of the molten steel reaches 0.01% by weight.

9. A process according to claim 5, wherein the injecting of only the oxygen comprises injecting only oxygen into an undeoxidized molten steel until the carbon content of the molten steel reaches a desired value; subsequently a vacuum decarburization treatment of the molten steel is carried out while the injection of the oxygen remains discontinued and until the carbon content of the molten steel again reaches a desired value, thereby preventing a deterioration of the degree of vacuum in the vacuum treatment vessel; and after the decarburization treatment, the injecting of both the oxygen and the gaseous fuel in the vacuum treatment vessel is carried out to heat the molten steel.

10. A process according to claim 9, wherein the injecting of the oxygen into the undeoxidized molten steel is discontinued when the carbon content of the molten steel reaches 0.02to 0.005% by weight.

11. A process according to claim 10, wherein the injecting of the oxygen into the undeoxidized molten steel is discontinued when the carbon content of the molten steel reaches 0.01% by weight.

12. A process according to claim 9, wherein the vacuum decarburization treatment is carried out until the carbon content of the molten steel reaches 0.0005 to 0.020% by weight.

13. A process according to claim 5, wherein the injecting of only the oxygen comprises injecting only oxygen into an undeoxidized molten steel from the top blow lance until the carbon content of the molten steel reaches 0.02 to 0.005% by weight; in a vacuum decarburization of the undeoxidized molten steel is thereafter completed while the injection of the oxygen is discontinued, thereby preventing a deterioration in the degree of a vacuum in the vacuum treatment vessel; and the injecting of both the oxygen and the gaseous fuel in the vacuum treatment vessel from the top blow lance is carried out until a vacuum treatment of the molten steel is completed.

14. An apparatus for vacuum degassing, said apparatus comprising: a vacuum treatment vessel; and a top blow lance extending vertically in the vacuum treatment vessel and supported so as to be movable in upward and downward directions relative to the vacuum treatment vessel, the top blow lance comprising an oxygen gas injection section including a throat and a tapered portion extending from the lower end of the throat both the throat and the tapered portion being coaxial with the axial center line of the lance, and a plurality of gaseous fuel supply ports provided in the tapered portion of the oxygen gas injection section.

15. An apparatus according to any one of claim 14, wherein the plurality of the fuel gas supply ports are provided symmetrically to the axial center line of the top blow lance.

16. An apparatus according to claim 15, wherein said plurality of gaseous fuel supply ports consist of 3 to 6 ports provided symmetrically to the axial center line of the top blow lance.

17. An apparatus according to claim 14, wherein said vacuum treatment vessel is one of an RH vacuum treatment vessel, a DH vacuum treatment vessel and a ladle vacuum treatment vessel.

18. An apparatus according to claim 14, wherein said vacuum treatment vessel is one of an RH vacuum treatment vessel, a DH vacuum treatment vessel, a treatment vessel immersed in molten steel and a ladle vacuum treatment vessel, said plurality of gaseous fuel supply ports consist of 3 to 6 ports provided symmetrically to the axial center line of the top blow lance, the tapered portion has a taper $\theta_1$ of 1° to 20°, and a ratio of $D_1/D_2$ of 1 to 40, $D_1$ being the inner diameter of the lower end of the tapered portion and $D_2$ being the inner diameter of the upper end of the tapered portion, and the fuel gas supply ports are provided at least 5 mm above the lower end of the tapered portion.

19. A process according to claim 10, wherein the vacuum decarburization treatment is carried out until the carbon content of the molten steel reaches 0.0005 to 0.020% by weight.

20. A process according to claim 11, wherein the vacuum decarburization treatment is carried out until the carbon content of the molten steel reaches 0.0005 to 0.020% by weight.

21. An apparatus according to claim 15, wherein said vacuum treatment vessel is one of an RH vacuum treatment vessel, a DH vacuum treatment vessel and a ladle vacuum treatment vessel.

22. An apparatus according to claim 16, wherein said vacuum treatment vessel is one of an RH vacuum treatment vessel, a DH vacuum treatment vessel and a ladle vacuum treatment vessel.

23. A process for vacuum degassing molten steel during a vacuum treatment of the molten steel, said process comprising:

providing a top blow lance, capable of injecting oxygen or an oxygen-containing gas and of injecting a gaseous fuel, respectively, on the top of a vacuum treatment vessel; and with the lower end of the top blow lance located a distance of 1.0 m or more from the surface of a molten steel bath in the treatment vessel, injecting both the oxygen or oxygen-containing gas and the gaseous fuel in the vacuum treatment vessel under a pressure in the vacuum treatment vessel of not more than 50 Torr during the vacuum treatment of the molten steel to burn the gaseous fuel and thereby heat the inner wall of the vacuum treatment vessel.

24. A process for vacuum degassing molten steel during a vacuum treatment of the molten steel, said process comprising:

providing a top blow lance, capable of injecting oxygen or an oxygen-containing gas and of injecting a gaseous fuel, respectively, on the top of a vacuum treatment vessel; and with the lower end of the top blow lance located a distance of 1.0 m or more from the surface of a molten steel bath in the treatment vessel, injecting both the oxygen or oxygen-containing gas and the gaseous fuel in the vacuum treatment vessel beginning when the pressure in the vacuum treatment vessel is lower than a pressure in the vessel when a reflux of the molten steel starts and until the vacuum degassing of the molten steel is completed to burn the gaseous fuel and thereby heat the inner wall of the vacuum treatment vessel.

25. A process for vacuum degassing molten steel during a vacuum treatment of the molten steel, said process comprising:

providing a top blow lance, capable of injecting oxygen or an oxygen-containing gas and of injecting a gaseous fuel, respectively, on the top of a vacuum treatment vessel, the blow lance being supported so as to be movable upwardly and downwardly relative to the vacuum treatment vessel;

while the lower end of the top blow lance is spaced not more than 2 m from the surface of a molten steel bath in the vacuum treatment vessel, injecting only oxygen into the molten steel from the top blow lance to decarburize the molten steel;

subsequently spacing the lower end of the top blow lance 1.0 m or more from the surface of the molten steel bath; and while the lower end of the top blow lance is located 1.0 m or more from the surface of the molten steel bath, injecting both the oxygen or oxygen-containing gas and the gaseous fuel in the vacuum treatment vessel to burn the gaseous fuel and thereby heat the inner wall of the vacuum treatment vessel.

26. A process for vacuum degassing molten steel during a vacuum treatment of the molten steel, said process comprising:

providing a top blow lance, capable of injecting oxygen or an oxygen-containing gas and of injecting a gaseous fuel, respectively, on the top of a vacuum treatment vessel, the blow lance being supported so as to be movable upwardly and downwardly relative to the vacuum treatment vessel;

while the lower end of the top blow lance is spaced not more than 2 m from the surface of a molten steel bath in the vacuum treatment vessel, injecting only oxygen into the molten steel from the top blow lance to decarburize the molten steel;

subsequently carrying out a deoxidation treatment of the molten steel and spacing the lower end of the top blow lance 1.0 m or more from the surface of the molten steel bath; and while the lower end of the top blow lance is spaced 1.0 m or more from the surface of the molten steel bath, injecting both the oxygen or oxygen-containing gas and the gaseous fuel in the vacuum treatment vessel to burn the gaseous fuel and thereby heat the inner wall of the vacuum treatment vessel.

27. A process for vacuum degassing molten steel, comprising:

providing a top blow lance, capable of injecting oxygen and a gaseous fuel, respectively, on the top of a vacuum treatment vessel, the blow lance being supported so as to be movable in upward and downward directions relative to the vacuum treatment vessel;

while the lower end of the top blow lance is spaced not more than 2 m from the surface of a molten steel bath, injecting only oxygen into the molten steel from the top blow lance to effect a decarburization of the molten steel;

while the lower end of the top blow lance is spaced 1.0 m or more from the surface of the molten steel bath, injecting both the oxygen and the gaseous fuel in the vacuum treatment vessel from the top blow lance to burn the gaseous fuel and thereby heat the inner wall of the vacuum treatment vessel.

28. A process according to claim 9, wherein after the decarburization of the undeoxidized molten steel by the injecting of only oxygen, a composition adjustment treatment to adjust the composition of the molten steel is also carried out by injecting both the oxygen and the gaseous fuel in the vacuum treatment vessel.

29. A process according to claim 10, wherein after the decarburization of the undeoxidized molten steel by the injecting of only oxygen, a composition adjustment treatment to adjust the composition of the molten steel is also carried out by injecting both the oxygen and the gaseous fuel in the vacuum treatment vessel.

30. A process according to claim 11, wherein after the decarburization of the undeoxidized molten steel by the injecting of only oxygen, a composition adjustment treatment to adjust the composition of the molten steel is also carried out by injecting both the oxygen and the gaseous fuel in the vacuum treatment vessel.

31. A process according to claim 12, wherein after the decarburization of the undeoxidized molten steel by the injecting of only oxygen, a composition adjustment treatment to adjust the composition of the molten steel is also carried out by injecting both the oxygen and the gaseous fuel in the vacuum treatment vessel.

32. A process according to claim 20, wherein after the decarburization of the undeoxidized molten steel by the injecting of only oxygen, a composition adjustment treatment to adjust the composition of the molten steel is also carried out by injecting both the oxygen and the gaseous fuel in the vacuum treatment vessel.

33. A process according to claim 20, wherein after the decarburization of the undeoxidized molten steel by the injecting of only oxygen, a composition adjustment treatment to adjust the composition of the molten steel is also carried out by injecting both the oxygen and the gaseous fuel in the vacuum treatment vessel.

34. A process according to claim 13, wherein the vacuum treatment includes a deoxidation treatment.

35. A process according to claim 13, wherein the vacuum treatment includes a composition adjustment treatment.

* * * * *

UNITED STATES PATENT AND TRADEMARK OFFICE

CERTIFICATE OF CORRECTION

PATENT NO. : 5,413,623

DATED : May 9, 1995

INVENTOR(S) : Kazuo OONUKI et al.

It is certified that error appears in the above-indentified patent and that said Letters Patent is hereby corrected as shown below:

In col. 17, line 69 (last line) the second occurrence of ";" has been deleted.

In col. 18, line 59, "ingecting" has been changed to —injecting—.

Signed and Sealed this

Eighth Day of August, 1995

Bruce Lehman

*Attest:*

BRUCE LEHMAN

*Attesting Officer*

*Commissioner of Patents and Trademarks*